US009504929B2

(12) United States Patent
Nilsson

(10) Patent No.: US 9,504,929 B2
(45) Date of Patent: Nov. 29, 2016

(54) CONSTRUCTION KIT

(71) Applicant: Jeff Nilsson, Karlstad (SE)
(72) Inventor: Jeff Nilsson, Karlstad (SE)

( * ) Notice: Subject to any disclaimer, the term of this patent is extended or adjusted under 35 U.S.C. 154(b) by 0 days.

(21) Appl. No.: 14/778,681
(22) PCT Filed: Mar. 19, 2014
(86) PCT No.: PCT/IB2014/000420
§ 371 (c)(1),
(2) Date: Sep. 21, 2015
(87) PCT Pub. No.: WO2014/147473
PCT Pub. Date: Sep. 25, 2014
(65) Prior Publication Data
US 2016/0051903 A1 Feb. 25, 2016
(30) Foreign Application Priority Data
Mar. 19, 2013 (SE) ..... 1350342
(51) Int. Cl.
*A63H 33/08* (2006.01)
*A63H 33/00* (2006.01)
*A63H 33/10* (2006.01)
(52) U.S. Cl.
CPC ..... *A63H 33/10* (2013.01); *A63H 33/107* (2013.01)
(58) Field of Classification Search
USPC ..... 446/85, 105, 108, 112, 115, 118, 122, 446/124, 125, 126, 128
See application file for complete search history.

(56) References Cited

U.S. PATENT DOCUMENTS 2,589,952 A * 3/1952 Mercier ..... A63H 33/102 403/233
3,362,739 A * 1/1968 Staeger ..... E04B 1/34384 52/285.1

(Continued)

FOREIGN PATENT DOCUMENTS

GB 2123682 A 2/1984
GB 2225808 A 6/1990
WO 2011003417 A1 1/2011

OTHER PUBLICATIONS

Swedish Office Action for counterpart Swedish Patent Application No. 1350342-0, Nov. 24, 2015, 4 pages.
International Search Report and Written Opinion dated Jul. 10, 2014 for PCT/IB2014/000420, 8 pages.
Chinese Office Action for Counterpart Chinese Patent Application No. 201480028777.7, English translation included, Aug. 26, 2016, 10 pages.

*Primary Examiner* — Kurt Fernstrom
(74) *Attorney, Agent, or Firm* — John M. Harrington, Esq.; Johnson, Marcou & Isaacs, LLC

(57) ABSTRACT

The present invention relates to a construction kit (B) comprising a position element (2) comprising at least one position pocket (21A, 21B, 21C, 21D) for positioning a construction plate (1), wherein the position pocket (21A, 21B, 21C, 21D) extends in a plane from an origin (0) in an imaginary three-dimensional coordinate system and comprises two interacting and opposite holding means (20A, 20B) with a distance (b) between them for holding the construction plate (1) in place, that the position pocket comprises a corner (h1) with an angle (v1) of 90° and two edges extending from said origin and forming said angle (v1) between them, that between said two opposite holding means (20A, 20B) said edges comprise an orthogonal connection (23) forming a support for the construction plate (1), when this has been placed into the position pocket (21A, 21B, 21C, 21D), wherein said holding means (20A, 20B) comprises two fixation means (24) which are symmetrically arranged on both sides of an imaginary diagonal (d), which extends from origin (0) in an imaginary square plane and in addition are arranged to interact with fixation means (10) of the construction plate for fixation thereof. Further, the construction kit comprises a construction plate (1) comprising at least one corner (h2) for positioning of the construction plate (1) in a position pocket (21A, 21B, 21 C, 21D) in a position element (2) according to the invention, which corner (h2) has a flat extension which at least comprises the extension of said position pocket (21 A, 21 B, 21 C, 11 D), wherein said corner (h2) starts from en origin (0) in an imaginary three-dimensional coordinate system and has an angle (v2) in the region of 45° to 90° with an imaginary diagonal (d) concerning a square plate, which diagonal (d) extends from origin (0), wherein the construction plate comprises at least one fixation means (10) arranged to interact with fixation means (24) of the position element (2), wherein said fixation means (20) is arranged beside said imaginary diagonal (d).

15 Claims, 6 Drawing Sheets

(56) References Cited

U.S. PATENT DOCUMENTS 3,528,559 A * 9/1970 Miller ..... E04B 2/7433 211/180
3,913,289 A * 10/1975 Recker ..... A47B 47/0033 108/180
4,209,934 A 7/1980 Ogawa et al.
4,470,647 A * 9/1984 Bishoff ..... F16B 5/07 312/108
5,291,700 A * 3/1994 Chew ..... A47D 13/00 160/135
5,647,181 A * 7/1997 Hunts ..... A63H 33/10 312/111
5,816,882 A * 10/1998 Guegan ..... A63H 33/12 446/113
6,014,842 A * 1/2000 Matsubara ..... E04B 5/14 446/115
8,753,162 B2 * 6/2014 Jensen ..... A63H 33/044 446/108
2002/0065018 A1 * 5/2002 Huang ..... A63H 33/042 446/112
2014/0256210 A1 * 9/2014 Johnson ..... A63H 33/046 446/108

* cited by examiner

CONSTRUCTION KIT

CROSS REFERENCE TO RELATED APPLICATIONS

This application is a 35 U.S.C. §371 national stage of International Application No. PCT/IB2014/000420 filed on Mar. 19, 2014, published in English under PCT Article 21(2), which claims the benefit of priority to Swedish Patent Application No. 1350342-0 filed on Mar. 19, 2013, the disclosures of which are hereby incorporated by reference.

TECHNICAL FIELD

The present invention relates to a construction kit, which comprises construction plates and position elements.

PRIOR ART

Since long it is known that people, both children and adults, find it amusing to build and screw together models/constructions of different kinds, besides being so amusing it is also instructive. Most people have very likely some time constructed something by means of MECCANO, LEGO or the like. Known construction kits often contain small and many different parts, which require good psychomotor skills and precision so that the constructor will be able to handle the small components and to have the ability to assemble the different parts to a model.

Through WO 2011003417 a construction kit is previously known with connection elements and wall panels, the corners of which are connected with the connection elements. Through DE 102011008137 a toy kit made of wood is previously known, wherein the building bricks are connected via couplings so that hinges are formed, Through WO 9842423 another variant of a construction kit is known, wherein the kit contains flat elements, shaped elements and elements assembled of the two first variants and may be used to build large toy constructions. In the document CA 212013 a construction kit is described consisting of panels and rails of varying sizes and shapes. The panels are inserted into grooves in the rails in order in such a way to build the desired construction.

DISCLOSURE OF THE INVENTION

The object of the present invention is to eliminate or at least minimize the problems mentioned above, which is achieved with position elements, construction plates and a construction kit in accordance with the claims.

Thanks to the invention a construction kit is provided comprising position elements and construction plates which makes it possible for persons already at a low age to build three-dimensional models in small as well as large sizes, as the idea is based on a simple and easy assembly of the pertinent parts, wherein only the creativity and the wealth of ideas stop what one may achieve.

According to an aspect of the invention, the construction kit consists of position elements, which comprise at least a position pocket comprising two interacting and opposite holding means with a distance between them, and adjacent to an edge of the these position pockets an orthogonal connection is provided between said two opposite holding means forming a partition wall, wherein said partition wall comprises a support for a construction plate placed in any of said position pockets and also comprises a connection means between two position pockets, which implies that a construction plate in a simple manner may be arranged in said position pocket and in place in the position pocket the construction plate is supported by the holding means.

According to another aspect of the invention, the position pockets comprise a corner each with an angle in the region of 20° to 90°, so that the construction plates with different angles of the corner arranged in the position pocket will fit into the position pocket and get a good support.

According to still another aspect of the invention said holding means preferably consist of two opposite, plane parallel position plates with a distance between them in the region of 1 mm to 20 mm, and wherein the distance is adapted to the thickness of the construction plate so that the construction plate with a certain resistance is pressed in between the position plates and there kept in place thanks to the distance being adapted to the construction plate so that it does not swing between the position plates.

According to an additional aspect of the invention the position plates comprise in said coiner at least a fixation means arranged just in front of each other, wherein said fixation means preferably comprises through holes, which are arranged to interact with the fixation means which implies that the construction plates and the position elements can be locked to each other and do not run the risk to collapse.

According to still an aspect of the invention the position plates preferably have a thickness in the region of 1 mm to 20 mm, which makes the position elements easy to handle.

According to another aspect of the invention the partition wall extends along at least one half the side length of the position plates, preferably along the entire side length, and is an effective stop as well as a position support for a construction plate.

According to an aspect of the invention, additional partition walls comprise a connection means between two position pockets, which implies that the construction plates may be inserted into different position pockets from different directions and the connection means is a support for these plates.

According to still an aspect of the invention, the position element comprises a plurality of position pockets with different angles between them, which implies that construction plates in different angles may be placed in one and the same position element and that three-dimensional models may be constructed.

According to an aspect of the invention, the construction kit comprises construction plates, which are essentially flat and comprise at least one corner, wherein said corner has an angle of between 20° and 90°, as well as comprise at least a fixation means being arranged to interact with a fixation means with a position element, which makes it easy to combine a construction plate and a position element and that the interacting fixation means makes it possible to lock the parts to each other to increase the security.

According to another aspect of the invention, the fixation means of the construction plates and the position elements consist of interacting through holes, which makes it possible to lock the parts to each other with fixation means such as screws and nuts.

According to an additional aspect of the invention, the construction plate has a thickness in the region of 1 mm to 20 mm, which thickness is adapted to the distance between the position plates, so that the construction plate with a certain resistance may be pressed between the position plates and there are kept in place thanks to the thickness being adapted to the distance, so that the plate is steadily positioned in the position element.

According to another aspect of the invention, the construction plate has a length in the region of 10 to 100 cm, which makes it easy to handle and simple to use for construction.

BRIEF DESCRIPTION OF DRAWINGS

The invention will below be described more in detail with reference to the enclosed drawings, of which.

DETAILED DESCRIPTION OF THE FIGURES

Figure 1:
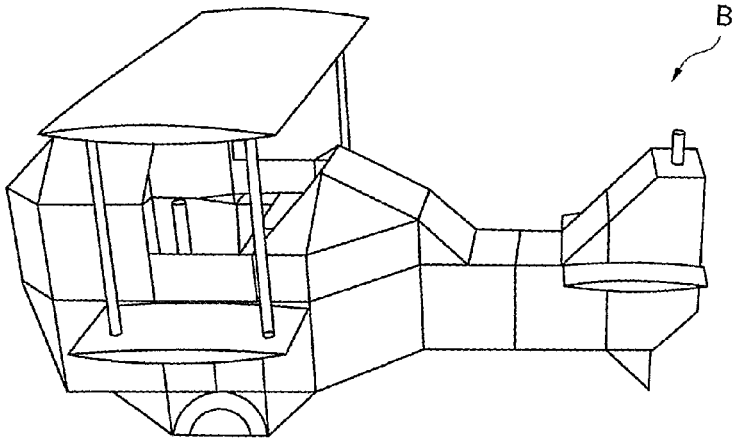
FIG. 1 shows a model, in a perspective view, assembled of a construction kit according to the invention.

FIG. 1 shows in a perspective view a model in the shape of an airplane with double wings assembled of a construction kit B according to the invention. The model is in the order of appr. 2×1×1.5 m, which gives a feeling for in which sizes the models may be built. The invention is not limited to exactly these dimensions but it is realized that they may be both considerably smaller and larger, if desired. The construction kit comprises position elements 2 and construction plates 1, which are mutually fixed by means of said positioning elements 2, which parts will be described in detail below.

An object of the construction kit B of the invention is to be able to build models in such a size that children and young people may climb and stay in the models which are constructed to stand such a load. The materials and dimensions described below are designed to stand such a load but it is realized that also other materials and dimensions may be suitable to stand this load. The construction kit B according to the invention may be made considerably larger or smaller than in the example described below. For instance, the dimensions could be reduced so that the models will become suitable for model builders and the pertinent parts may then stand a smaller load. Likewise, the dimensions of the construction kit B may be made larger so that also adults will be able to play and stay in/on the models and in such a case the pertinent parts need to stand a heavier load. The pertinent parts of the construction kit B are thus adapted to the desired use.

Figure 2:
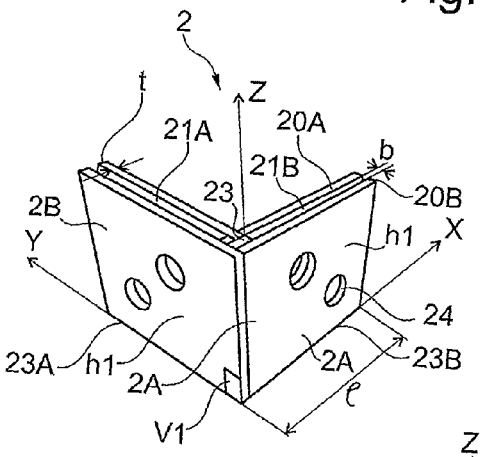
FIG. 2 shows an alternative of a position element in a perspective view according to the invention.

FIG. 2 shows a variant of a position element 2 according to the invention, seen from a perspective view. The position element 2 comprises a first 21A and a second 21B position pocket. The first position pocket 21A extends in a plane (0, Y, Z) in an imaginary Cartesian coordinate system with the axes (X, Y, Z) and the second position pocket 21B extends in a plane (X, 0, Z) in the same coordinate system starting from origin. The first 21A and the second 21B position pockets each comprise two interacting and opposite holding means 20A, 20B with a distance b between each other. Said holding means 20A, 20 B preferably comprise two opposite, plane-parallel position plates 20A, 20B. Adjacent to an edge of these position pockets 21A, 21B, an orthogonal connection 23 is arranged between said two opposite position plates 20A, 20B forming a partition wall 23 between the position pockets 21A, 21B, Further, said partition wan 23 is a support for said construction plate 1 placed in any of said first and second position pockets 21A, 21B and is also a connection means between two position pockets 21A, 21B. The partition wall 23 starts from origin in the above imaginary coordinate system, wherein the partition wall extends along an imaginary Z-axis, and the first 21A and the second 21B position pockets extend from said partition wall 23 in the Y- and X-direction, respectively. The first and the second position pockets 21A, 21B are thus arranged with an angle of 90° between them with a common partition wall 23. Further, the position pockets 21A, 21B comprise a corner h1 each, which corner h1 has an angle v1 extending from any of said coordinate axes, X, Y, Z, of the coordinate system. The angle v1 has a size in the region of 20° to 90°, more preferred in the region of 30° to 90°, and most preferred in the region of 45° to 90°, wherein the angle v1 of the first position pocket 21A extends between the Y- and Z-axes, while the angle v1 of the second position pocket 218 extends between the X- and Z-axes. In the example described here, the angle v1 is 90°. The distance b between the position plates 20A, 20B is in the region of 1 mm to 20 mm, more preferred 2 mm to 15 mm, and most preferred 3 mm to 8 mm. The position plates 20A, 20B each comprise at least one, but preferably two, fixation means 24 in said corner h1, arranged opposite to each other. Preferably, said fixation means 24 consist of through holes 24, the centre of which is arranged at an angle of 15° to 30° and/or 60° to 75°, preferably 22.5° and/or 67.5°, wherein the angle extends between the Y- and I-directions, and X- and Z-directions, respectively. The fixation means 24 are arranged to interact with fixation means 25, e.g. screws and nuts.

The position plates 20A, 20B has a thickness t in the region of 1 mm to 20 mm, more preferred 2 mm to 15 mm, and most preferred 3 mm to 6 mm, in the example described here 4 mm. Further, the position plates 20A, 20B have a side length 1 in the region of 20 mm to 150 mm, more preferred 40 mm to 100 mm, and most preferred 70 mm to 90 mm.

Said partition wall 23 extends along at least half the side length 1 of the position plates 20A, 20B, preferably along the entire side length land is a connection means between the first 21A and the second 21B position pocket and is also a support for a construction plate 1 placed in any of the position pockets 21A, 21B. The position pockets 21A, 21B may also comprise additional partition walls 23 along any other edge of the position pocket 21A, 21B, wherein these partition walls 23 then comprise a support for a construction plate 1 placed in any of said position pockets 21A, 21B. The position element 2 described in FIG. 2 comprises a common partition wall 23 for the two position pockets 21A, 21B, wherein the common partition wall 23 extends in the Z-direction along an imaginary Z-axis. Further, the two position pockets 21A, 21B also comprise an orthogonal connection 23 each between said two opposite position plates 20A, 20B, is wherein the orthogonal connection 23 consists of side walls 23A, 23B, wherein the side wall 23A in the first position pocket 21A extends in the Y-direction along an imaginary Y-axis, and the side wall 23B in the second position pocket 21B extends in the X-direction along an imaginary X-axis, In this embodiment, the side walls 23A, 23B of each position pocket 21A, 21B are arranged at an angle of 90° to the common partition wall 23 (not shown), so that a construction plate 1 placed in any of the position pockets 21A, 21B is supported by the partition wall 23 and the side wall 23A, 23B of the position pocket 21A, 21B. It is realized that an orthogonal connection 23 between two opposite position plates 20A, 20B, partly may be a partition wall between two position pockets such as the partition wall 23 running in the Z-direction in FIG. 2, partly is a distance between the opposite position plates 20A, 20B and is a support for a construction plate arranged in the position pocket 21A, 21B. In case the orthogonal connection 23 runs e.g. in the X-direction and the Y-direction in FIG. 2, the orthogonal connection 23 is a distance between the opposite position plates 20A, 20B and a support for a construction plate 1 arranged in the position pocket 21A, 21B and may also be a distance towards the base.

Figure 3:
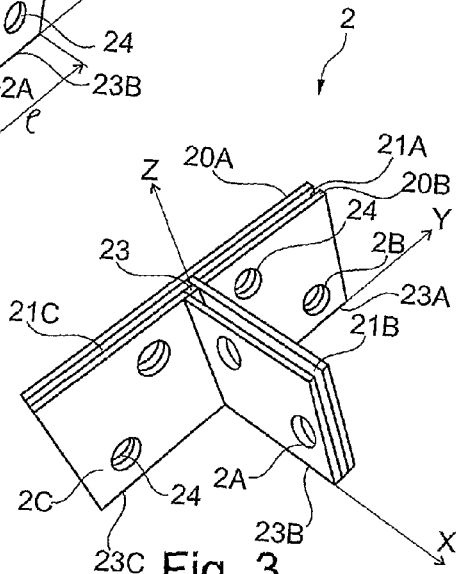
FIG. 3 shows, in a perspective view, an alternative of a position element according to the invention.

The position element 2 may also comprise additional position pockets. A variant of such an example is shown in FIG. 3, where the position element 2 comprises a third 21C position pocket, which position pocket 21 extends in a plane (0, Y, Z) from the common partition wall 23 of the first 21A and the second 21B position pockets, and is arranged at an angle of 90° in relation to the second position pocket 21B. Also the third position pocket 21C comprises a side wall 23C, which side wall 23C extends in a negative Y-direction along the imaginary Y-axis. Thus, all three position pockets 21A, 21B, 21C extend in different planes from the common partition wall 23, which extends in the Z-direction along the imaginary Z-axis. In this embodiment, where the first 21A and the second 21B position pockets, and the second 21B and the third 21C position pockets, respectively, are arranged with a relative tingle of 90°, the position element 2 gets the shape of a capital T. The man skilled in the art realizes that a fourth 21D position pocket may be arranged at an angle of 90° in relation to the third 21C position pocket, wherein the position element 2 gets the shape of a plus sign (+).

Within the frame of the invention idea it is possible to create alternative position elements 2 with still more position pockets and/or where the pertinent position pockets may be arranged in different planes in the coordinate system. The common partition wall 23 may be regarded as a hinge, wherein position pockets may be turned and arranged in different directions/planes based thereon. The partition wall 23 permits a desired angle between at least two position pockets 21A, 21B, 21C in at least two arbitrary planes in the space. The position elements 2 are manufactured in one piece, preferably by extrusion or injection moulding. It would also be possible to mill the different parts of the position elements 2 and to assemble them with glue, for instance.

Figure 4:
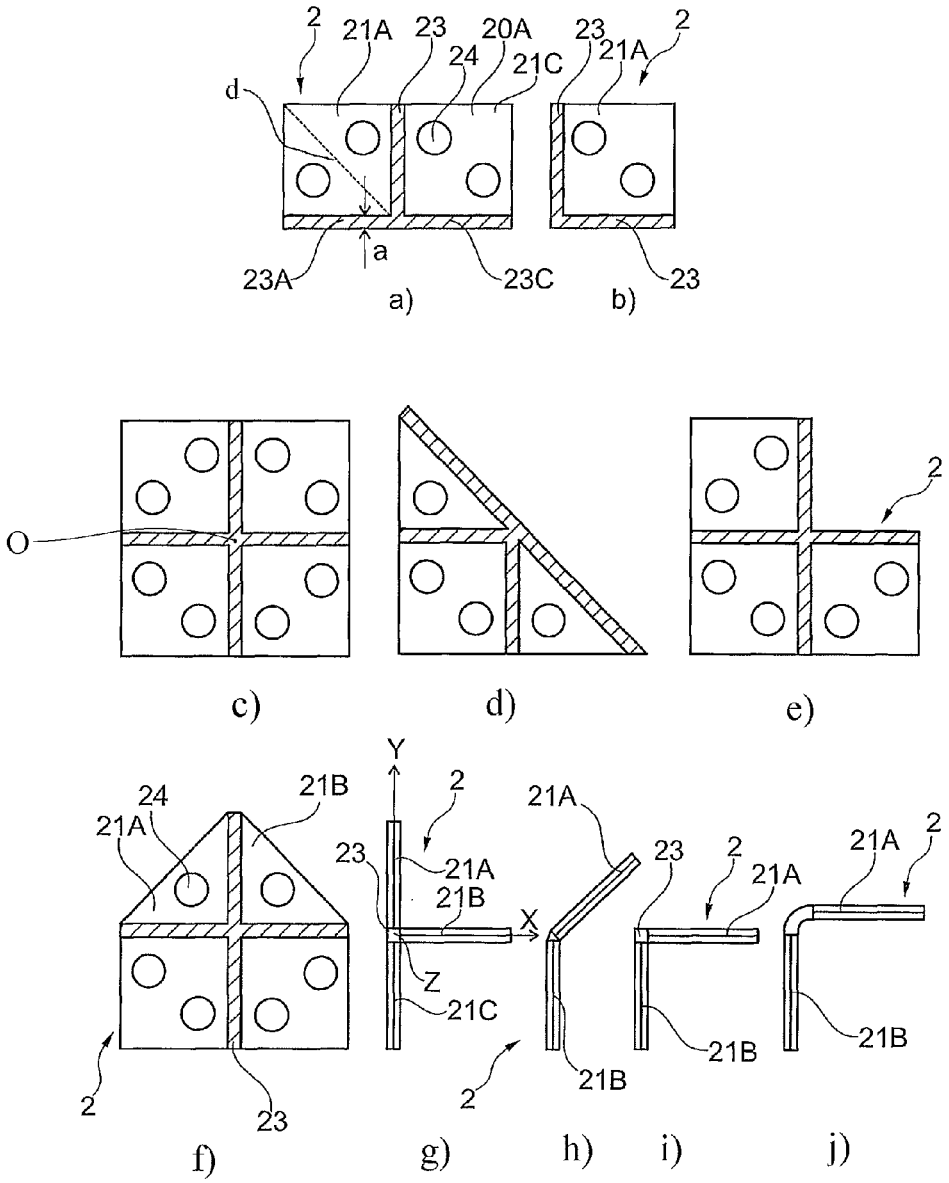
FIG. 4 shows, seen from the side, a number of different embodiments of position elements according to the invention.
Figure 9:
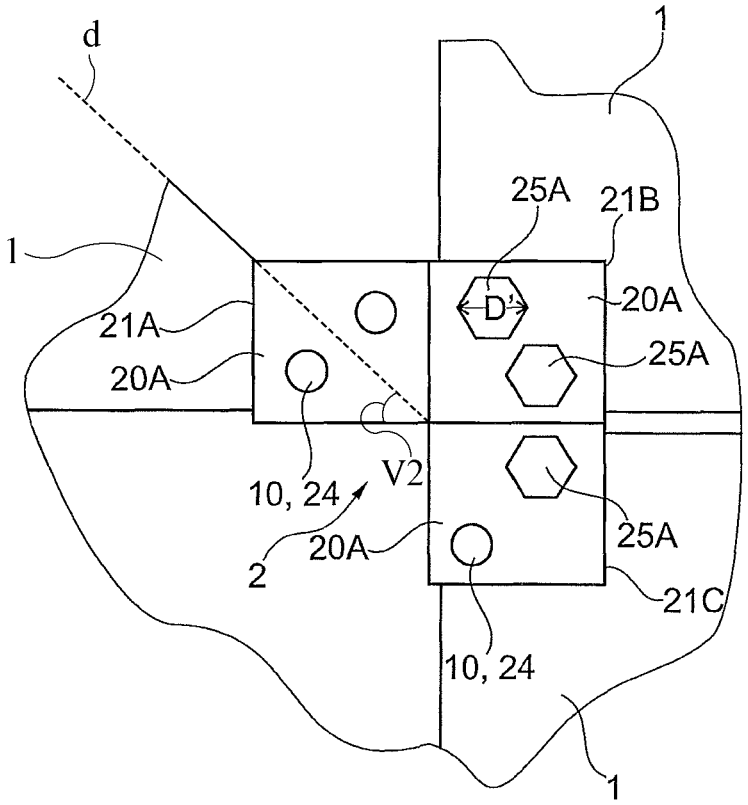
FIG. 9 shows, seen from the side, construction plates assembled with a position element according to the invention.

In FIGS. 4 *a-f*, a number of different examples are shown of embodiments of a position element 2, The position element 2 is seen from the side and in cross-section. It is realized that they may also comprise position pockets entering into the figure, so that for instance the position element 2 shown in FIG. 4*a* could have a portion running straight into the figure, and thus then get the embodiment described in FIG. 3. The position element 2 described in FIG. 4 *b* could look like both the position element 2 described in FIG. 2 and also like the one described in FIG. 3. In common for all position elements 2 is that they comprise an origin, from which one or several position pockets extend. In case a position element 2 comprises more than one position pocket, the position element 2 has a common partition wall 23 between two position pockets. Further, each position pocket 21A-D preferably also has a sidewall 23A-D along the side of respective position pocket extending along any of the axes of the imaginary coordinate system. In FIG. 4*f*, the first 21A and the second 21B position pocket have an alternative location of the fixation means 24 than the one described above, which is, however, not included in the invention. The man skilled in the art realizes that the fixation means 24 may be arranged in a plurality of alternative ways besides the one described here without departing from the object of the invention. Preferably, the fixation means 24 are symmetrically arranged at both sides of an imaginary diagonal d starting from origin O, in an imaginary square plane, as inter alia is shown in the preferred embodiments. In this way, the advantage is achieved that the construction plates then may be turned in arbitrary directions. It will also be possible to arrange construction plates, the corner h2 of which has an angle being below 90°, but the fixation means of which are still arranged according to the idea of the invention about a symmetric location on both sides of an imaginary diagonal d starting from origin 0 in an imaginary square plane, which only interact with the fixation means 24 at one side of the diagonal in a position pocket, and still achieve a stable fixation of the construction plate in the position element. In FIG. 9 a construction plate with an angle v2 of 45° is shown in the upper, left position pocket, wherein the imaginary diagonal d thus coincides with one edge of the construction plate. The fixation means 10 of the construction panel 1 is thus arranged beside said imaginary diagonal d and interacts with the fixation means 24 of the position pocket 20A. FIG. 4*g-j* shows four different variants of position elements 2, seen straight from above, i.e. an imaginary Z-axis runs from the paper towards the viewer, so that e.g. the position element 2 described in FIG. 3 can be seen in FIG. 4*g*. Thus, all three position pockets 21A, 21B, 21C extend in different planes from the common partition wall 23 extending in the Z-direction along the imaginary Z-axis. In this embodiment, the first 21A and the second 21B position pockets, and the second 21B and third 21C, respectively, position pockets are arranged with a relative angle of 90°, By wing the position element 2, shown in FIG. 4*h*, a sloping surface may be obtained, when a construction plate 1 is arranged in the first position pocket 21A. The man skilled in the art realizes that by combining different shapes of position pockets 21A, 21B, 21C, 21D a desired position element 2 is obtained, wherein each position pocket may receive portions of a construction plate 1, which will be described in detail below. By providing position elements 2 with position pockets in a number of different angles and models, one may in an easy way build a three-dimensional model with all possible inclinations of the pertinent construction plates 1.

Figure 5:
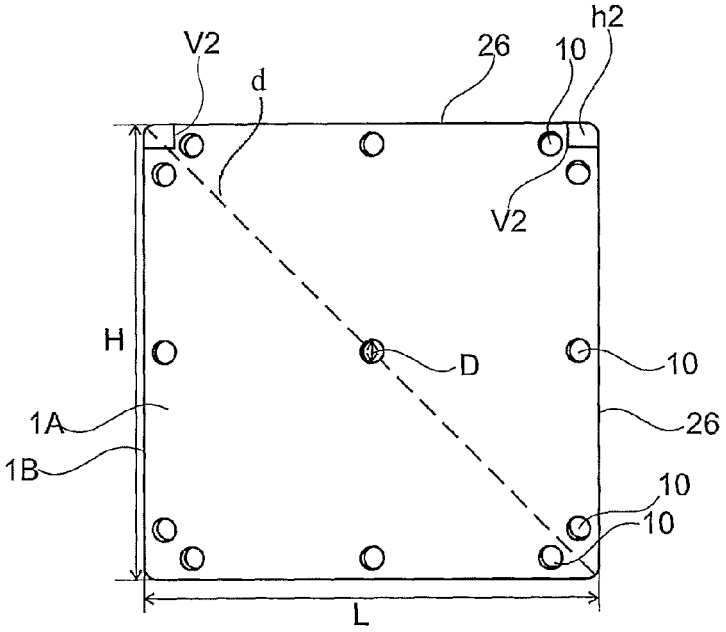
FIG. 5 shows, seen from the side, a construction plate according to the invention.
Figure 6:
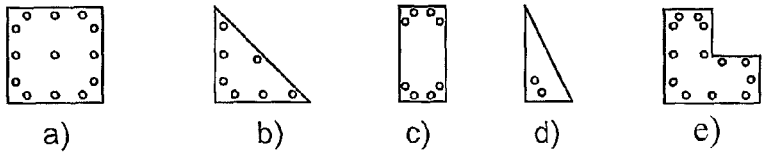
FIG. 6 shows, seen from the side, a number of different embodiments of construction plates according to the invention.

FIG. 5 shows a construction plate 1 according to the invention, wherein said construction plate 1 is essentially flat and comprises at least one corner h2. When said corner h2 is inserted into a position pocket as described above, the construction plate 1 extends in the same plane as the position pocket 21A, 21B, 21C, 21D and shares the same origin 0 in the same imaginary coordinate system. The corner h2 has an angle in the region of 20° to 90°, more preferred in the region of 30° to 90°, and most preferred in the region of 45° to 90°, and comprises at least one fixation means 10 arranged to interact with the fixation means 24 of the position element 2. At the fixation of the construction plate 1 in the position pocket 21A-*d*, at least one, but preferably two, of the sides 26 of the construction plate extending from the corner h2 interacts with the partition wall 23 and the sidewall 23A-D of the position pocket 21A-D.

The construction plate 1 has a thickness T in the region of 1 mm to 20 mm, more preferred 2 mm to 15 mm, and most preferred 3 mm to 6 mm. The construction plate 1 has a length L and a height H in the region 10 cm to 100 cm, more preferred 20 cm to 60 cm, and most preferred a length L and a height H of 30 cm. The construction plates 1 are manufactured of a durable material such as plastics, e.g. PVC, or wood such as plywood, and have preferably somewhat rounded corners to avoid that anyone hurts himself thereon. The construction plate 1, shown in FIG. 5, is square with a side of 30 cm and with a thickness T of 4 mm. It is understood that the thickness T is adapted to the distance b between the position plates 20A, 20B of one position pocket 21A, 21B, 21C, 21D. In addition to this, the thickness T is adapted to the material chosen for the construction plate, so that the construction plate 1 is given a strength, which in the embodiment shown implies that models may be built, which stand load from playing children and young people. The dimensions and material of the position element 2 is chosen in the same way to give the model enough strength. Likewise the fixation means described below.

In this described example, the construction plate 1 comprises 13 fixation means 10, in this case fixation through holes 10 having a diameter D in the region of 2 mm to 25 mm, more preferred 5 mm to 10 mm. A fixation hole 10 is arranged in the centre of the plate, one at the middle on each edge 25 of the plate 1 and two in each corner h2. The two fixation holes 10 in each corner of the construction plate are preferably symmetrically arranged on each side of an imaginary diagonal d of the construction plate. The diagonal d extends from en origin 0 in an imaginary plane, in which the corners h2 of the construction plate extend. Preferably, said fixation means 10 consist of through holes 24, the centre of which is arranged at an angle of 15° to 30° and/or 60° to 75°, preferably 22.5° and/or 67.5° from any of said coordinate axes X, Y, Z of said coordinate system, wherein the angle extends between the Y- and Z-directions, and X-and Z-directions, respectively. The fixation means 10 are arranged to interact with fixation means 25, e.g. screws and nuts.

In order to be able to build different models, it is advantageous that the construction plates 1 are available in all possible conceivable shapes, e.g. square, rectangular, triangular or other geometric shapes. A number of shapes of the construction plate 1 according to the invention is shown in FIGS. 6*a-e*. In a construction kit according to the invention, it is desirable to be able to combine construction plates 1 in an optional manner, and therefore the length of the sides H, L of the construction plates of the different variants included in the construction kit is multiples of a length X and the thickness a of the partition wall 23, where a is the sum of the thickness t of the two position plates 20A, 20B and the distance b between the position plates 20A, 20B, i.e. a=2t+b. It is also possible to have construction plates 1 which are thinner than described above, for example if a bonnet of a model shall be built, a construction plate 1 may be used which is as thin that it is bendable to form a bonnet and wherein the edges/corners of the thin plate is inserted in a position pocket 21A, 21B, 21C, 21D and fastened with fixation means 25. Thus, it is realized that that portion of the construction plate 1 which is inserted into a position pocket 21A, 21B, 21C, 21D preferably is essentially flat while the remaining portion may have other shapes.

Figure 7:
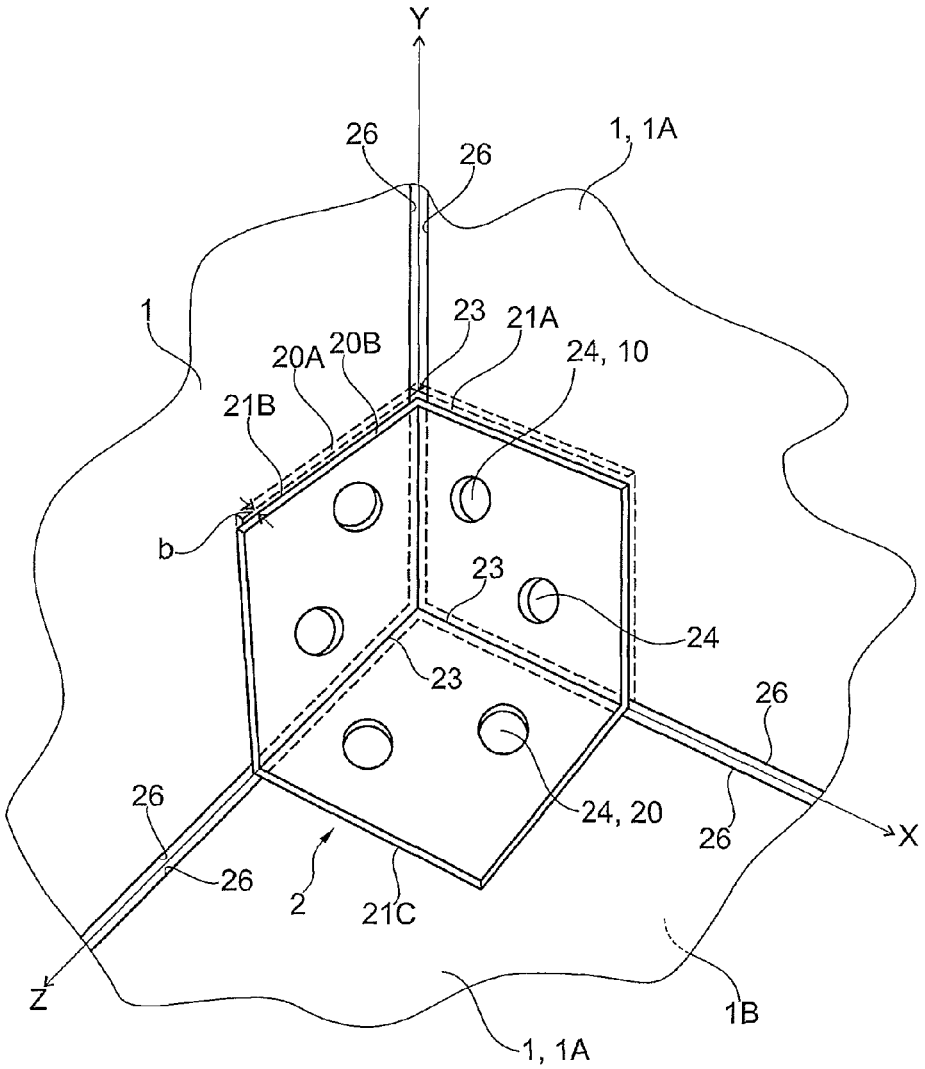
FIG. 7 shows a corner of an assembled model according to the invention.

FIG. 7 shows a corner of a three-dimensional model assembled of three construction plates 1 and one position element 2. The position element 2 comprises three position pockets 21A, 21B, 21C with a common origin 0. The first position pocket 21A extends in the plane (X, Y, 0), the second position pocket 21B extends in the plane (0, Y, Z), and the third position pocket 21C extends in the plane (X, 0, Z). The first 21A and the second 21B position pockets have a common partition wall 23 extending from origin 0 along the Y-axis. The second 21B and the third 21C position pockets have a common partition wall 23 extending from origin 0 along the Z-axis. The third 21C and the first 21A position pockets have a common partition wall 23 extending from origin 0 along the X-axis. At assembly the corner h2 of the construction plate 1 is inserted into one of the position pockets 21A, 21B, 21C until the side edges 245 of the plate abut against the two holding-ups 23 in the position pocket into which the construction plate 1 has been inserted. When the construction plate 1 has been inserted into one position pocket 21A, 21B, 21C, 21D, the construction plate 1 extends in the same plane as the position pocket 21A, 21B, 21C, 21D. The coiner h2 of the construction plate abuts against origin 0 in the position element 2. Said distance b between the position plates 20A, 20B is larger than the thickness T of the plate, b>T.

The distance b between the two position plates 20A, 20B is adapted to the thickness T of the construction plate in such a manner that a certain resistance is present at the insertion of the construction plate 1 into the position pocket 21A, 21B, 21C, so that a tight abutment arises between the construction plate 1 and the two position plates 20A, 20B. When the construction plate 1 has been inserted into a position pocket 21A, 21B, 21C, 21D, it shall maintain its position when the person who is building releases its hold in order to catch possible fixation means. In this way, the construction plate 1 maintains its position, as the two position plates 20A, 20B abut against and gives support to portions of the side surfaces 1A, 1B of the construction plate. When the construction plate 1 has been placed in the position pocket 21A, 21B, 21C, the fixation holes 10 of the construction plate and the fixation means 24 of the position element, in this example through holes, are arranged in such a way that they coincide so that some kind of fixation means 25 may be used to fix the construction plate 1 in the position pocket. Further, a second and a third construction plate 1 may be inserted in the other position pockets 21A, 21B, 21C in the same way as described above. From this position, construction plates 1 may then, by means of different position elements 2, be built in several directions entirely depending on the position element 2 being used. In order to build three-dimensional models, it should be possible to angle the construction plates 1 in different directions/angles and it is then realized that a position element 2 may be provided with position pockets in a number of different planes. Thus, it is also possible is to build models with non-right corners. The position pockets 21A, 21B, 21C, 21D may then be arranged so that the angle between two position pockets 21A, 21B, 21C, 21D may be both acute and obtuse and not only 90°, as described above.

The diameter D of the fixation holes 10 preferably corresponds to the diameter D' of the fixation means 24, and a fixation means 25 could be a screw 25A and a nut 25B. FIG. 9 shows a position element 2 with a first 21A, a second 21B and a third 21C position pocket. Construction plates 1 are arranged in all three position pockets, so that the fixation holes 10 of the construction plate and the fixation means 24 of the position pockets coincide and overlap each other. In the upper left position pocket an example is shown how a construction plate 1 is arranged with a corner h2, the angle v2 of which is below 90°, more exactly the angle is v2=45°. Here it is shown how the fixation holes 10 of the construction plate, which are arranged beside the imaginary diagonal d, coincide with the fixation means 24 of the position pocket at one side of the imaginary diagonal d. Here, it is also shown that the position of the fixation hole 10 of the construction plate 1 with the angle v2=45° uses the same concept of the invention, wherein the position of the fixation hole 10 coincides with the position of any of the fixation means 24, which according to the idea of the invention is symmetrically arranged on each side of the imaginary diagonal d, which extends from origin 0 in an imaginary square plane. Thus, the construction plate 1 may be afforded a good fixation also with an angle v2 being below 90°. A screw 25A and a nut 25B (not shown) are arranged through the fixation hole 10 as well as through the fixation means 24 of the second position pocket 21B. In the example here described, the head of the screw 25A has a diameter D' of 20 mm to 30 mm, suitably about 25 mm, which is a suitable size for children to handle and also for persons using the construction kit in a purpose of rehabilitation. Another important aspect of the invention is that when the screw 25A and the nut 25B are used as fixation means, the diameter D' of the head of the screw 25A should not be larger than there being room for the head inside the edges of the position plates 20A, 20B, as otherwise the two screws 25A used in two adjacent position pockets run the risk to be a hindrance for each other. For the same reason, the large diameter D" of the nut 25B should not be larger than there being room for it inside the edges of the position plates. In FIG. 9 a screw 25A and a nut 25B are arranged through the two fixation means 24 of the second position pocket 21B and the fixation hole 10 of the construction plate, and in the third position pocket 21C a screw 25A and a nut 25B are arranged through the fixation means 24/fixation holes 10 adjacent to the second position pocket 21B. If there would not be room for the diameter D' of the head of the screw 25A or the large diameter D" of the nut 25B within the edges of the position plate 20A, it would not be possible to arrange screws 25A in all desired fixation means 24/fixation holes 10, as they would interfere with each other's rotation region and cannot be turned. Consequently, it is an advantage that there is room for the diameter D' of the screw head within the edges of the position plate 20A.

Figure 8:
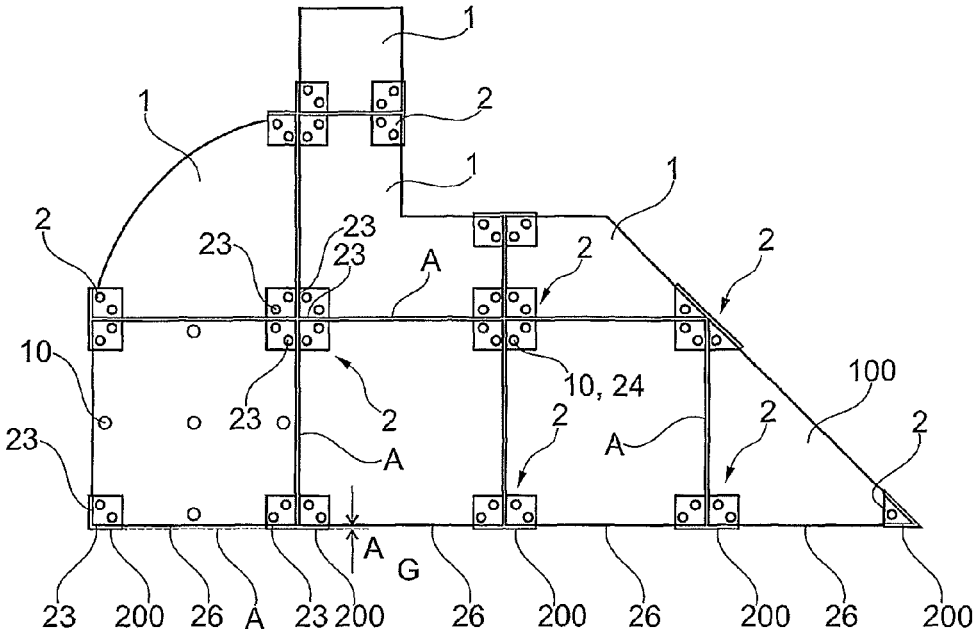
FIG. 8 shows, seen from the side, assembled construction plates and position elements according to the invention.

FIG. 8 shows, from the side, a number of different models of construction plates I and position elements 2 according to the invention, which have been assembled. It shall be realized that the model shown in FIG. 8 may also have parts running directly into the figure if it is a three-dimensional model. At the very bottom of the figure it can be seen how the model rests on a floor G and the portion of the model which has contact with the floor G is a bottom side 200 of the position elements 2 which are nearest the floor G. In the example described, the orthogonal connection 23 of the position elements 2 has a thickness of 4 mm, but the man skilled in the art realizes that it may vary and be both thicker and thinner, if desired. The orthogonal connection 23 creates a distance A between the ground (floor) G and the edges 26 of the plate as well as also between the different construction plates 1. The distance A between the construction plates is essentially as large as the thickness a of the partition wall 23. In order to get a model smooth, it is preferred that all corners of the construction plates 1 have a position element 2. For instance, if the construction plate, which in FIG. 8 has got the designation 100, does not have any parts behind running straight into the figure but that construction plate 100 is single, the position element 2 to the right at the very bottom of the figure comprises only one position pocket, and the position elements 2 has the function to bring the construction plate 100 at the same level as other construction plates in the lowest row against the ground G.

By combining different construction plates 1 with different position elements 2 it is only the fantasy which limits what models to build. An idea is to provide completed model kits, wherein the content forms a certain model, e.g. an airplane with double wings as shown in FIG. 1. Then, the construction kit comprises the construction plates 1 and the position elements 2 necessary for the assembly of the airplane. The idea also comprises that it will be possible to fasten the construction plates 1 and the position elements 2 to each other by e.g. screws and nuts to secure that the different parts do not drift apart at possible play inside/on the models. It is preferred that a screw is used with a diameter of the screw head in the region of 1 cm to 4 cm depending on the size of the construction plates and the position elements, which implies that children manage the psychomotor dulls necessary to handle screws and nuts. It is also conceived that the construction kit could contain a tool, which e.g. is cut out of plastics and shaped as an adjustable spanner which as to measure is adapted to screw/nut. The construction kit is a suitable product to be used in preschools, after-school recreation centres, hospitals, etc, but, of course, it is also a product for private homes. The construction is also intended to be used within care as a "healing tool" in a rehabilitation phase at damages again to increase psychomotor skills, thinking and creation in an easy and funny way. An additional idea with the construction kit is that, when completed models are offered, it is possible that the plates 1 are available in any embodiments in one colour to different structures such as brick, stone, wood, log, etc and entirely transparent (e.g. Plexiglas) for windows, etc; all in order to get so a realistic model as possible. Further, it is conceived that the construction kit may contain accessories such as a gear level, controls, pedals, steer wheel, lamps, light bars, hinges, rods, carpets, dashboard, rotor blades, chairs, batteries, electric motors, etc. Then, also the accessories are provided with fixation means so that they may be arranged on the model in an easy manner via the position means 10 of the plate and/or via the position elements 2. In order further to strengthen the adventure, the construction kit may be completed with cloths, weapons, helmets, spectacles, dolls, curtains, etc to get a realistic and funny environment.

The invention is not limited to the above description but may be varied within the scope of the appending claims. For instance, it is realized that the fixation means of the position elements and the construction plates may be other than through holes. For example, they could in some of the parts be holes while it in the other part are bulges which at the insertion of the construction panel into the position element plop into the through holes and at the dismounting the bulges are pressed inwards to allow the parts to be released from each other. Instead of screws and nuts, it would also be possible to use a locking pin which is inserted through the holes of the position element and the construction plate, and when it has been inserted, a portion of the locking pin is put down into an orthogonal position and locks so that the pin does not return through the holes. At the dismounting, the orthogonal portion is turned to the same position as the locking pin and it may be brought through the holes and the parts separated.

The invention claimed is:

1. A position element (2) for a construction kit (B) comprising a plurality of position pockets (21A, 21B, 21C, 21D) for positioning of a construction plate (1), wherein each position pocket (21A, 21B, 21C, 21D) extends in a plane from an origin (0) in an imaginary three-dimensional coordinate system and comprises two interacting and opposite holding plates (20A, 20B) with a distance (b) between them for holding the construction plate (1), each position pocket (21A, 21B, 21C, 21D) further comprising an orthogonal connection (23) between said two opposite holding plates (20A, 20B), said orthogonal connection (23) forming a support for the construction plate (1) when this has been placed into the position pocket (21A, 21B, 21C, 21D), wherein at least two of said interacting and opposite holding plates (20A, 20B) of at least one of the plurality of position pockets comprise two fixation means (24) in the form of through holes which are symmetrically arranged on both sides of an imaginary diagonal (d) extending from said origin (0) in an imaginary square plane of said position pocket and in addition is arranged to interact with fixation means (10) of the construction plate for fixation thereof.

2. The position element (2) according to claim 1, wherein said orthogonal connection (23) forms a partition wall (23) between two of said plurality of position pockets (21A, 21B, 21C, 21D) and comprises a connection means between them.

3. The position element (2) according to claim 1, wherein said distance (b) is in the region of 1 mm to 20 mm.

4. The position element (2) according to claim 1, wherein said fixation means (24) comprise through holes (24) arranged opposite to each other in the position plates (20A, 20B), wherein the centre of the holes (24) is arranged in an angle of 15° to 30° from any of the coordinate axes (X, Y, Z) of said coordinate system and is arranged to interact with fastening means (25).

5. The position element (2) according to claim 1, wherein said position plates (20A, 20B) have a thickness (t) in the region of 1 mm to 20 mm.

6. The position element (2) according to claim 1, wherein said position plates (20A, 20B) have a side length (1) in the region of 20 mm to 150 mm.

7. The position element (2) according to claim 1, wherein said partition wall (23) extends along at least half the side length (1) of the position plates (20A, 20B).

8. The position element (2) according to claim 1, wherein additional ones of said plurality of position pockets (21A, 21B, 21C, 21D) are connected with either of said two position pockets (21A, 21B, 21C, 21D) via at least one additional partition wall (23).

9. The position element (2) according to claim 2, wherein the partition wall (23) establishes a predetermined angle between the position pockets (21A, 21B, 21C, 21D) extending in at least two different planes.

10. A construction plate (1) for a construction kit (B) comprising at least one corner (h2) for positioning the construction plate (1) in a position pocket (21A, 21B, 21C, 21D) in a position element (2), which corner (h2) has a flat extension which at least comprises the extension of said position pocket (21A, 21B, 21C, 21D), wherein said corner (h2) starts from an origin (0) in an imaginary three-dimensional coordinate system and has an angle (v2) in the region of 45° to 90° to an imaginary diagonal (d) concerning a square plate, which diagonal (d) extends from origin (0), wherein the construction plate comprises at least one fixation means (10) arranged to interact with fixation means (24) of the position element (2), wherein said at least one fixation means (10) is arranged beside said imaginary diagonal (d).

11. The construction plate (1) according to claim 10, wherein the centre of said fixation means (10) is arranged at an angle of 15° to 30° and/or 60° to 75° from any of the coordinate axes (X, Y, Z) of said coordinate system.

12. The construction plate (1) according to claim 10, wherein said fixation means (10) are arranged to interact with fastening means (25).

13. The construction plate (1) according to claim 10, wherein said construction plate (1) has a thickness (T) in the region of 1 mm to 20 mm.

14. The construction plate (1) according to claim 10, wherein said construction plate (1) has a length (L) in the region of 10 cm to 100 cm.

15. The construction plate (1) according to claim 10, wherein said construction plate (1) has a height (H) in the region of 10 cm to 100 cm.

* * * * *